US005284082A

United States Patent [19]

Sprafke et al.

[11] Patent Number: 5,284,082

[45] Date of Patent: Feb. 8, 1994

[54] AMMUNITION BUNKER RESTING AGAINST A MILITARY-TANK TURRET

[75] Inventors: Uwe Sprafke, Schauenburg; Klaus Hersemeyer, Kassel; Klaus-Peter Pietrzok, Kaufungen, all of Fed. Rep. of Germany

[73] Assignee: Firma Wegmann & Co. GmbH, Kassel, Fed. Rep. of Germany

[21] Appl. No.: 48

[22] Filed: Jan. 4, 1993

[30] Foreign Application Priority Data

Jan. 16, 1992 [DE] Fed. Rep. of Germany ..... 4200903

[51] Int. Cl.[5] ..... F41H 5/20

[52] U.S. Cl. ..... 89/36.13; 89/34

[58] Field of Search ..... 89/34, 36.08, 36.13

[56] References Cited

U.S. PATENT DOCUMENTS

| | | | |
|---|---|---|---|
| 4,454,799 | 6/1984 | Gilvydis | 89/34 |
| 4,864,913 | 9/1989 | Grünewald et al. | 89/34 |
| 4,928,574 | 5/1990 | Golden | 89/36.13 |

FOREIGN PATENT DOCUMENTS

| | | | |
|---|---|---|---|
| 2858251 | 5/1989 | Fed. Rep. of Germany | 89/36.08 |

*Primary Examiner*—Stephen C. Bentley

*Attorney, Agent, or Firm*—Sprung Horn Kramer & Woods

[57] ABSTRACT

An ammunition bunker rests against a military tank turret. The bunker's outward-facing walls are scored. The bunker wall facing the crew compartment is unscored. The ammunition stowed in the interior of the bunker points away from the crew compartment. The bunker is a separate and totally enclosed housing. The housing rests in a matching niche in the surface of the turret. One wall of the housing faces the crew compartment at a prescribed distance away from its wall. The roof of the housing consists of a number of separate plates resting in the interstices of a stationary grating. When the stowed ammunition explodes and the explosion increases the pressure inside the housing to a prescribed level, the pressure will break the scored walls apart at the scores, mold the wall of the housing that faces the crew compartment against the crew-compartment wall, and lift the plates out of the interstices in the grating.

3 Claims, 4 Drawing Sheets

AMMUNITION BUNKER RESTING AGAINST A MILITARY-TANK TURRET

BACKGROUND OF THE INVENTION

The invention concerns an ammunition bunker resting against a military tank turret. The bunker's outward-facing walls are scored. The bunker wall facing the crew compartment is unscored. The ammunition stowed in the interior of the bunker points away from the crew compartment. When the stowed ammunition explodes and the explosion suddenly increases the pressure inside the housing to a prescribed level, the pressure will break the scored walls apart at the scores.

An ammunition bunker of this type is described, for example, in U.S. Pat. No. 4,864,913 which corresponds to German patent 2 552 470.

Specially designed scores in the outward-facing walls of the known bunker leave it stable and resistant to attack from outside. If on the other hand the stowed ammunition should explode, the force of the explosion is intended to break the outward-facing walls apart at the scores without injuring the crew.

Tests have demonstrated, however, that the interior pressure often rises too rapidly during an explosion, especially when propulsive charges for several shells detonate inside a bunker simultaneously, to be released rapidly enough by the known approach alone. The unscored wall between the bunker and the crew compartment can succumb and the crew can be injured. The pressure could also be released more rapidly if the explosion lifted the roof of the bunker, but the conventional roofs are too heavy to be lifted readily.

SUMMARY OF THE INVENTION

The object of the present invention is accordingly to improve an ammunition bunker of the aforesaid type to the extent that, when even several shells explode simultaneously inside it, the increase in interior pressure will be decelerated and eventually prevented, and the crew will be protected even more effectively although the bunker remains as stable as necessary.

This object is attained in accordance with the invention in that the bunker is a separate and totally enclosed housing resting in a matching niche in the surface of the turret with one wall facing the crew compartment at a prescribed distance away from its wall and with a roof consisting of a number of separate plates resting in the interstices of a stationary grating such that, when the stowed ammunition explodes and the explosion suddenly increases the pressure inside the housing to a prescribed level, the pressure will mold the wall of the housing that faces the crew compartment wall against the crew-compartment wall and lift the plates out of the interstices in the grating.

The theory of the invention comprises, first, designing the bunker in contrast to known versions as a housing completely separate from the crew compartment with the wall facing the wall of the compartment made from such a material and so dimensioned that in the event of an interior explosion it will deform as if it were being shaped by a known industrial explosive-molding process and be forced against the crew-compartment wall, consuming part of the explosion's energy and increasing the resistance of the crew-compartment wall. Second, while the bunker's roof will basically be stable enough to resist impacts from outside, an explosion inside the bunker will perforate it by ejecting the individual plates, which are small enough to be ejected more rapidly.

Another advantage of an ammunition bunker in the form of a separate housing is that, if it is attached to the turret by a single hinge, it can as a whole be lifted or pivoted out from the turret. This feature entails even more advantages. Pivoting the bunker out will expose the conventional loading port between it and the crew compartment, allowing the stowage and removal of additional ammunition in and from the turret. The port can also be exploited as an emergency exit for the crew.

One embodiment of an ammunition bunker in accordance with the invention will now be specified with reference to the accompanying drawings.

DETAILED DESCRIPTION OF THE INVENTION

Figure 1:
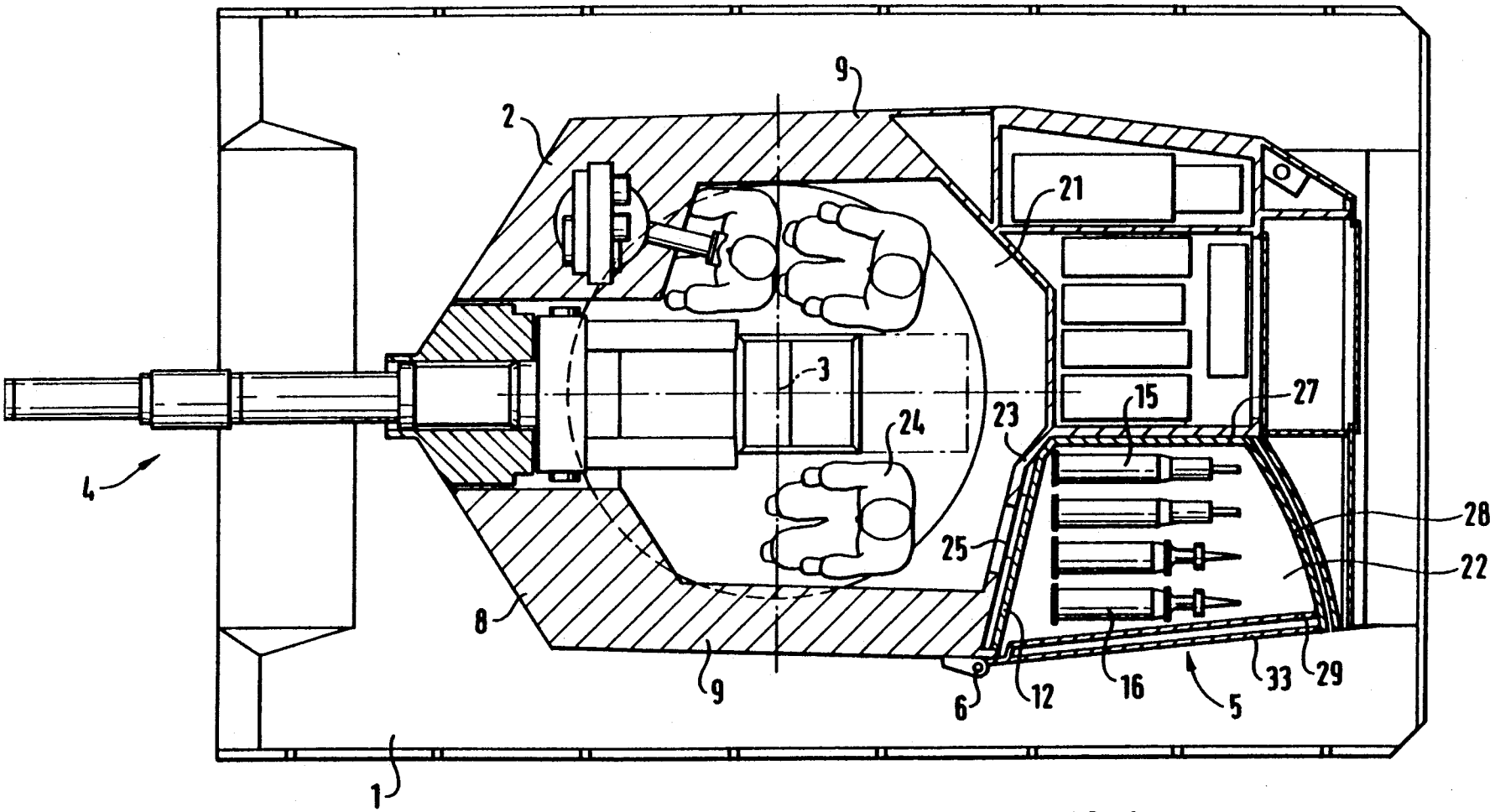
FIG. 1 is a horizontal section through a military-tank turret with an ammunition bunker.

The military tank 1 schematically illustrated in FIG. 1 has a turret 2 that rotates around a vertical axis 3. Turret 2 accommodates a heavy weapon 4 that extends through its front. The turret contains a crew compartment 21 surrounded by particularly powerful armor that comprises two components. Component 8 protects against frontal and component 9 against flank attack. To the rear of crew compartment 21 and on the left half of the tank is an ammunition bunker 5. The interior 22 of bunker 5 accommodates shells 15 and 16. The shells are oriented with their points facing away from the crew compartment, specifically to the rear.

Figure 2:
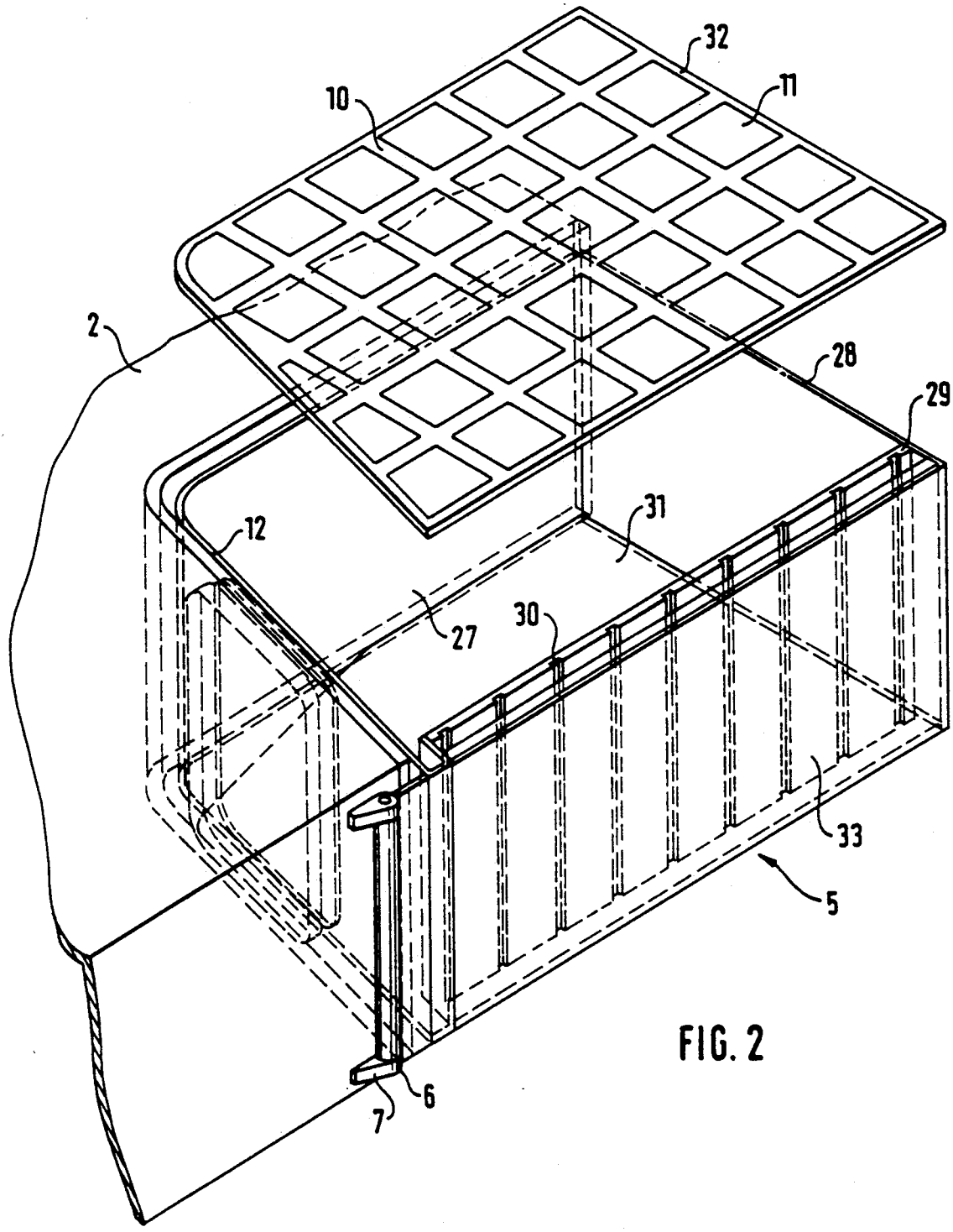
FIG. 2 is a perspective view of part of the bunker illustrated in FIG. 1 in position and with its roof removed.

Bunker 5 is a separate and totally enclosed housing with outward-facing walls 27, 28, and 29, a wall 12 facing crew compartment 21, a floor 31, and a roof 32 (see FIG. 2). The rear of crew compartment 21 is demarcated in the vicinity of bunker 5 by a wall 23. Wall 23 contains a port 25. Between the bunker wall 12 facing crew compartment 21 and the crew-compartment wall 23 facing bunker 5 is a gap **23*a* of prescribed width. The gap 23*a* accommodates a door 26 that slides back and forth across port 25. Specifically, the gap 23*a* is dimensioned such that in the event of an explosion in the interior 22 of bunker 5 the pressure will force door 26 tight into port 25, sealing off crew compartment 21, and bunker wall 12 against crew-compartment wall 23. Bunker wall 12** is made of a material, steel for example, appropriate for explosive molding. ST 52 steel is particularly appropriate.

As shown in FIG. 2, the outer surface of the outward-facing bunker walls, lateral bunker wall 29 for example, are scored with perpendicular break-apart grooves 30. The top and bottom of the perpendicular strips of lateral bunker wall 29 demarcated by grooves 30 are secured to the outer edge of floor 31 and bunker roof 32 by an unillustrated weld and will accordingly resist the stress of an artillery attack. The weld, however, is not powerful enough to resist the pressure of an internal explosion. Thinner armor 33 without scores can for practical purposes be mounted just outside the outward-facing bunker walls.

Figure 5:
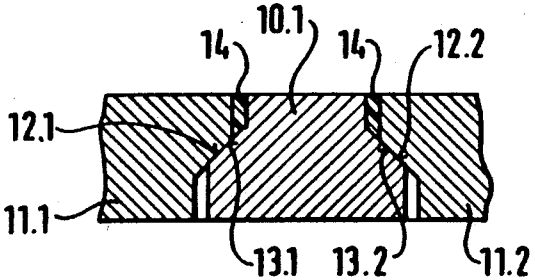
FIG. 5 is a larger-scale section through the area X in FIG. 4.

Bunker roof 32 is specifically designed to both rise and perforate in the event of an internal explosion. The roof is for this purpose constituted by a grating 10 with interstices that accommodate plates 11 in such a way that an explosion in the interior 22 of bunker 5 will force them out. The details of bunker roof 32 will be evident from FIGS. 3 through 5.

Figure 3:
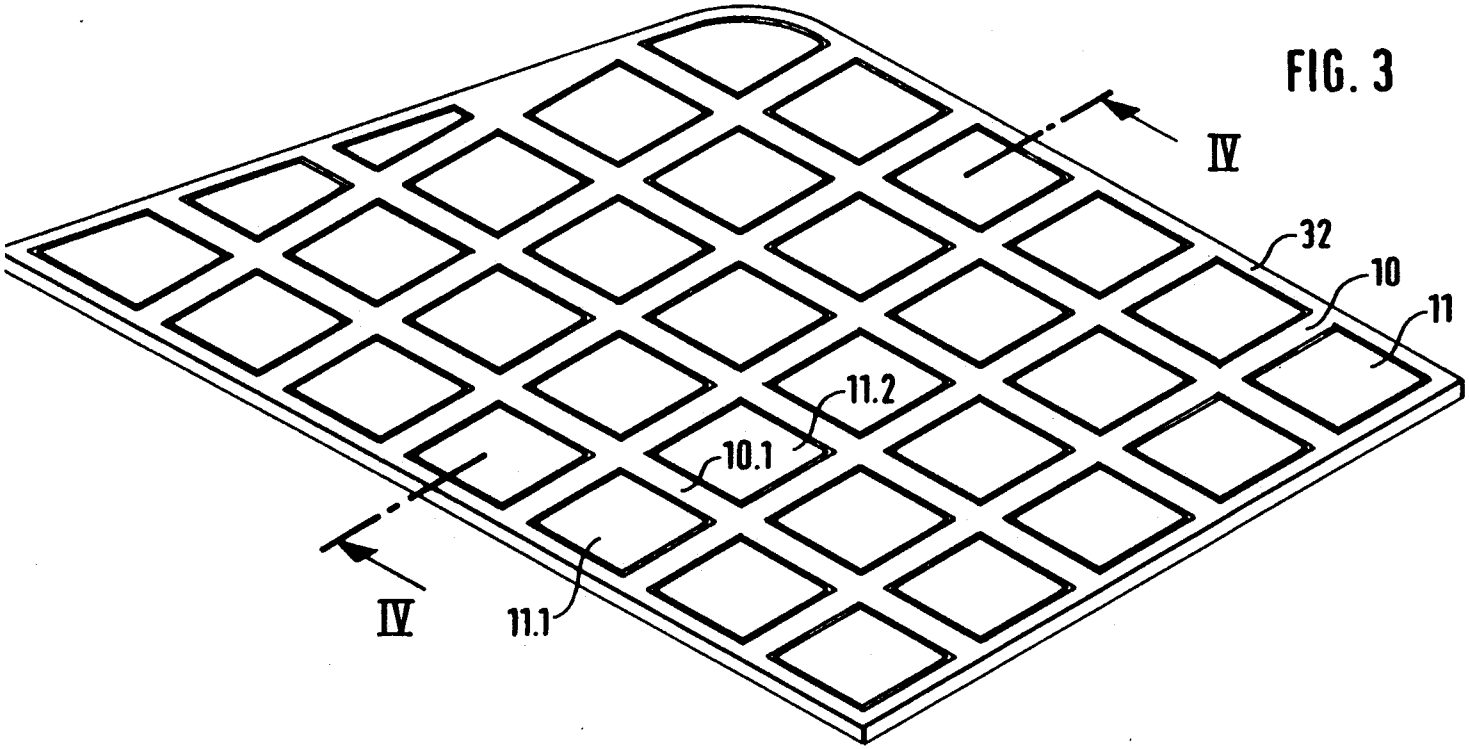
FIG. 3 is a slightly larger-scale perspective view of the bunker roof illustrated in FIG. 2.
Figure 4:
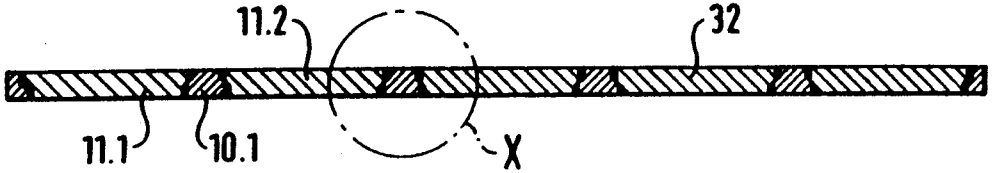
FIG. 4 is a section along the line IV—IV in FIG. 3.

FIGS. 3 and 4 illustrate adjacent roof plates 11.1 and 11.2 separated by a grating web 10.1. The area where plates 11.1 and 11.2 rest against web 10.1 is indicated by the dot-and-dash circle X in FIG. 4 and is illustrated in larger scale in FIG. 5. The edges of each plate 11.1 and 11.2 have sections 12.1 and 12.2 that slope discontinuously together toward the interior 22 of bunker 5. There is a sloping section 12.1 or 12.2 on each edge of each plate 11.1 and 11.2 resting against matching sloping sections 13.1 and 13.2 on the edges of each web 10.1. A seal 14, of silicone for example, has been introduced from outside the roof into the gaps between plates 11.1 and 11.2 and web 10.1 to secure the plates in the grating. It has been demonstrated that a roof of this design will succumb more readily to an interior explosion than a conventional scored roof will.

An explosion inside the bunker will accordingly have the following results.

1. The bunker wall 12 facing crew compartment 21 will be forced against the crew-compartment wall 23 facing bunker 5.
2. The outward-facing bunker walls, especially lateral bunker wall 29, will break apart at the scores and eject.
3. Bunker roof 32 will rise and its individual plates 11 will be forced out of grating 10.

The stress on the crew-compartment wall 23 facing bunker 5 will accordingly be limited and the wall will survive intact. Shells 15 and 16 can still be removed from bunker 5 by loader 24 through port 25, which coincides with a matching opening in bunker wall 12, once door 26 has been slid out of the way.

Figure 6:
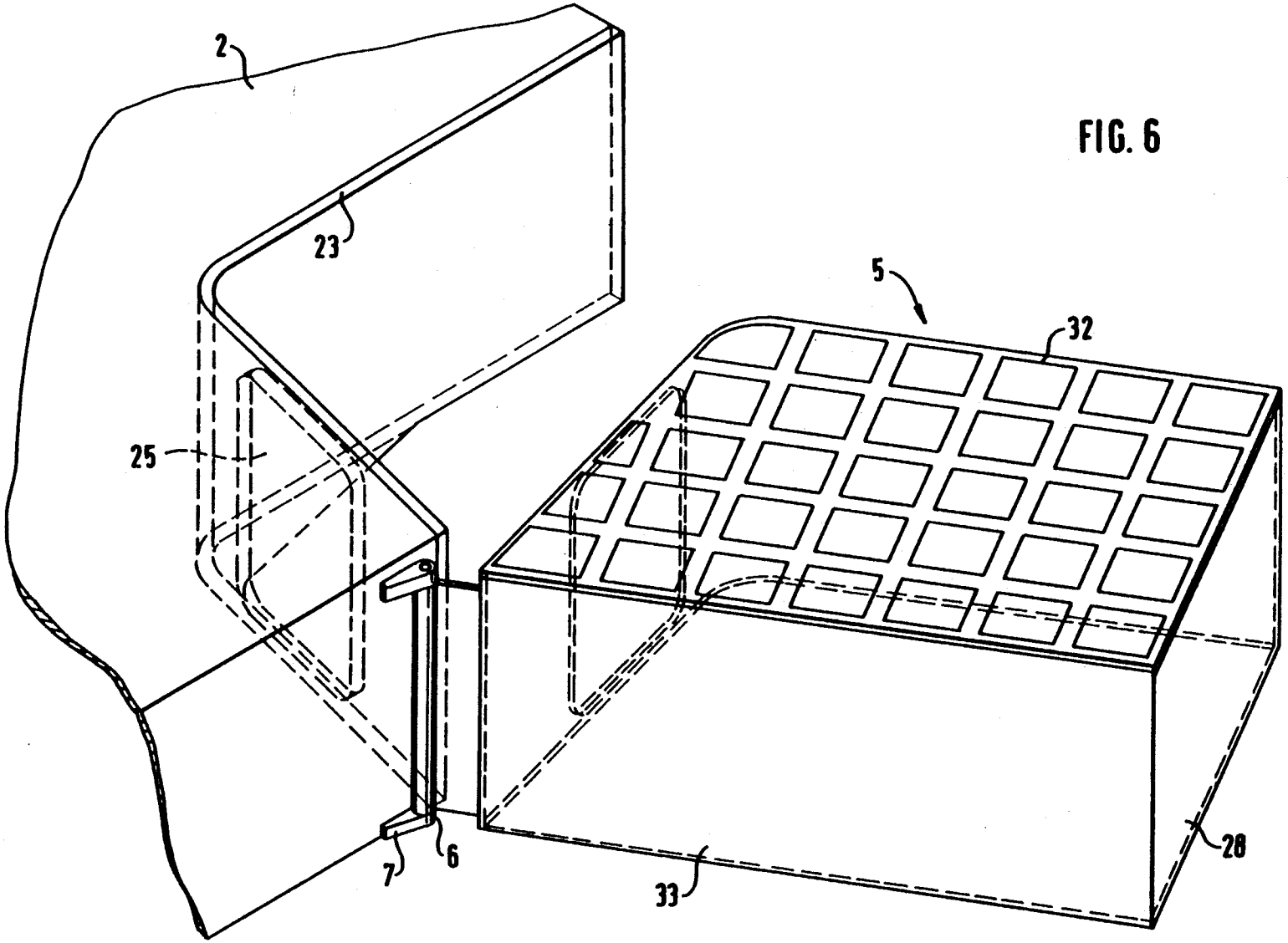
FIG. 6 is a view similar to that in FIG. 2 but of the bunker pivoted out and with its roof in place.

As will be evident from FIGS. 1, 2, and 6, bunker 5 constitutes a separate and inherently stable housing mounted against turret 2 on a hinge 6 and secured by a bracket 7 such that it can be pivoted out of the surface of the turret horizontally. FIG. 6 illustrates bunker 5 pivoted out. Only a bunker in the form of such a separate housing can be swung out in such a way. A bunker of this type also has other advantages. It provides access to port 25 from outside the vehicle for instance, allowing ammunition to be directly introduced into and removed from crew compartment 21. Port 25 can also be employed as an escape hatch while the bunker is pivoted out.

What is claimed is:

1. In a military tank having a turret with a crew compartment and means forming an ammunition bunker disposed immediately adjacent to the turret and having an unscored wall facing the crew compartment, means for storing ammunition in the bunker pointing away from the crew compartment, scored outwardly facing walls breakable at the scores in response to a given pressure level in the bunker caused by exploding stored ammunition, the improvement wherein the turret has means forming a niche in one wall thereof configured to receive the ammunition bunker; wherein the means forming the ammunition bunker comprises a totally enclosed housing separate from the turret, means connecting the housing to the turret to space the unscored wall of the housing facing the crew compartment at a given distance from the one wall of the turret to permit the unscored wall of the housing to mold against the one wall of the turret in response to pressure in the bunker caused by an explosion of stored ammunition and wherein the housing comprises a roof including a grating having a plurality of interstices, a plurality of plates and means mounting the plates in the interstices of the grating to permit the plates to lift out from the grating and outwardly of the housing in response to pressure in the bunker caused by an explosion of stored ammunition.

2. The military tank according to claim 1, wherein each of the plates is essentially rectangular and the means mounting the plates comprises the edges of each plate slope discontinuously together towards a bottom surface of the plate and the grating has a matching slope on edges thereof such that the edges of the plates rest against the edges of the grating and a seals introduced from outside the housing into gaps between the edges of the plates and the grating.

3. The military tank according to claim 1, wherein the means connecting the housing to the turret comprises means connecting the housing for pivotal movement around a vertical axis toward and away from the one wall of the turret.

* * * * *